United States Patent [19]

Park

[11] Patent Number: 4,517,908

[45] Date of Patent: May 21, 1985

[54] AUTOMATIC NOTCHING DEVICE IN A SEWING MACHINE

[75] Inventor: Kwang S. Park, Incheon, D.P.R. of Korea

[73] Assignee: Daewoo Heavy Industries Ltd., Incheon, D.P.R. of Korea

[21] Appl. No.: 619,938

[22] Filed: Jun. 12, 1984

[30] Foreign Application Priority Data

Sep. 9, 1983 [KP] D.P.R. of Korea ..... 83-7970

[51] Int. Cl.[3] ..... D05B 37/02

[52] U.S. Cl. ..... 112/129

[58] Field of Search ..... 112/129, 122, 123 R, 112/125

[56] References Cited

U.S. PATENT DOCUMENTS 4,384,540 5/1983 Vollmar et al. ..... 112/129

FOREIGN PATENT DOCUMENTS 3144965 5/1983 Fed. Rep. of Germany ..... 112/122

45-22700 7/1970 Japan ..... 112/129

*Primary Examiner*—Werner H. Schroeder

*Assistant Examiner*—Andrew M. Falik

*Attorney, Agent, or Firm*—Fleit, Jacobson, Cohn & Price

[57] ABSTRACT

An automatic notching device in a sewing machine comprises a worm engaged with a worm gear fixed to a driving shaft of the sewing machine, a driving cam having a cam portion formed with a plurality of protrusions and a cylindrical boss portion, and an actuating link pivotally moved dependant on the movement of said cam. A cutter-holding member is provided to move upwardly and downwardly by the movement of actuating link transmitted via a linkage member and a swing arm. During the movement of the cutter-holding member, the cutter cooperates with a cutter-guiding member disposed adjacent to a side of needle-guiding member, in order to effect a simultaneous notching operation in sewing a curved portion of garment. The notching device further comprises a push rod having at one end a lever and at the other end a yoke. An actuating shaft is connected at one end to said yoke and has a roller at its other end. Depending upon the position of the lever the roller is moved upwardly or downwardly. When the roller engages said cam portion it is in a notching position, whereas when it engages said boss portion it is in a non-notching position.

1 Claim, 5 Drawing Figures

AUTOMATIC NOTCHING DEVICE IN A SEWING MACHINE

BACKGROUND OF THE INVENTION

This invention relates to an automatic notching device in a sewing machine for preventing the formations of wrinkles in clothes in sewing a curved portion such as a shoulder of upper garment.

Conventionally, notching work has been manually performed by using scissors or the like. This results in not only decreasing an efficiency of the work, but also increasing the cost of production due to the increase of personnel expenses where certain workers are required only for the performance of notching work.

SUMMARY OF THE INVENTION

This invention has been designed to overcome the above-mentioned problem. Accordingly, an object of the invention is to provide an automatic notching device in a sewing machine enabling an automatic notching of the curved portion of garment in sewing thereof.

This object of the invention is accomplished by providing an automatic notching device which comprises a worm fixedly mounted to a driving shaft of sewing machine, a rotating shaft provided at one end thereof with a worm gear engaging with said worm, a cam mounted to the other end of said rotating shaft, said cam having a cam portion formed with a plurality of protrusions and a boss portion, an actuating shaft provided at one end thereof with a roller engaging with said cam, a link provided at one end thereof with a bearing member supporting said actuating shaft, said link being pivotable around the other end thereof, a yoke provided with a slot receiving the other end of said actuating shaft, a push rod connected at one end thereof to said yoke and having at the other end thereof a lever, a swing arm connected at one end thereof to said link via a linkage member, and a cutter mounted to the other end of said swing arm.

Other objects and advantages of this invention will be apparent from the following details description and the drawings.

DESCRIPTION OF THE PREFERRED EMBODIMENT

Figure 1:
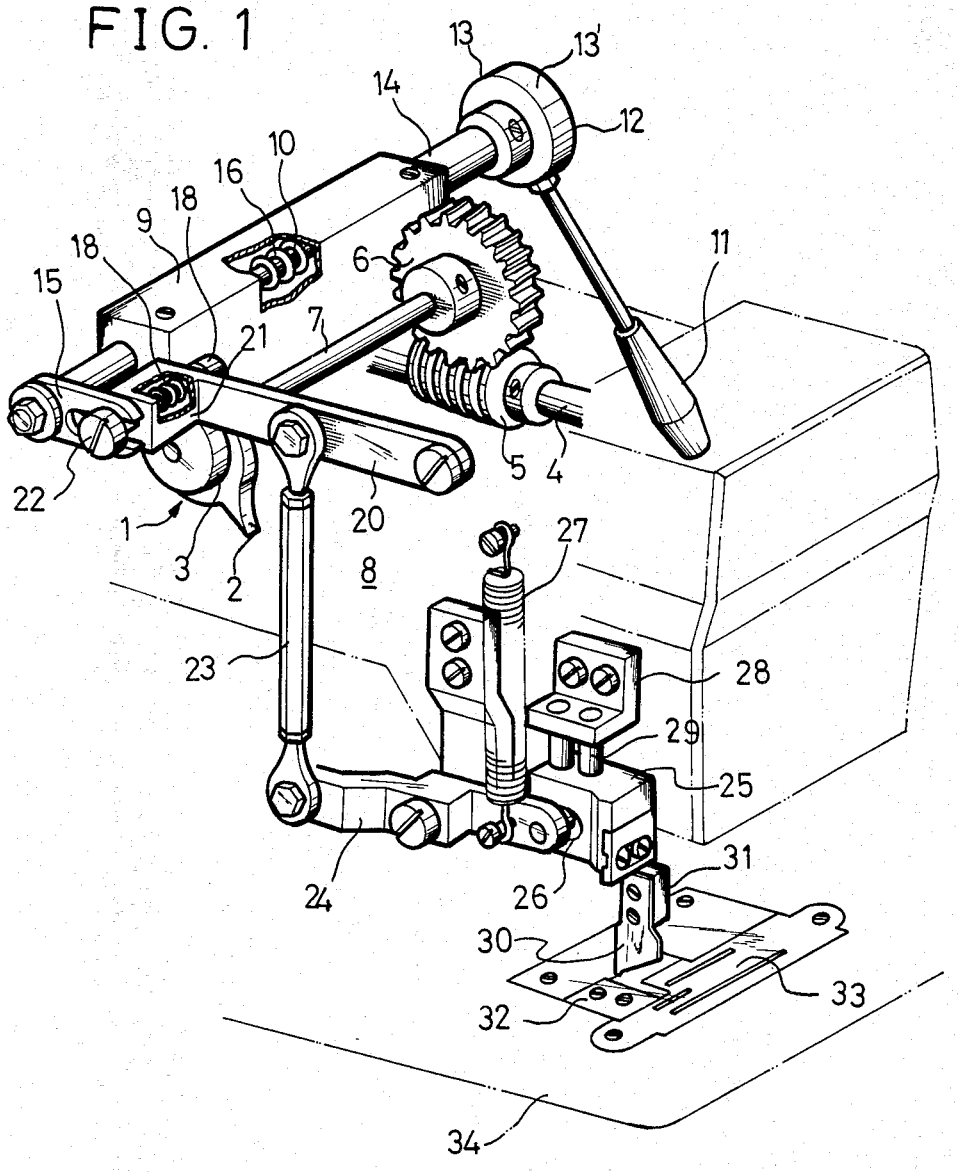
FIG. 1 is a perspective view of an embodiment of the invention.

In FIG. 1, reference numeral 1 indicates a driving cam which includes a cam portion having at the periphery thereof a plurality of protrusions 2 and a boss portion 3 formed integrally with the cam portion. The driving cam 1 is fixedly mounted to one end of a rotating shaft 7. The shaft 7 is rotatably connected to a driving shaft 4 via a worm 5 and worm gear 6. The worm 5 and worm gear 6, which are fixedly mounted to the driving shaft 4 and the other end of shaft 7, transmit a torque of the driving shaft 4 at a certain reduction speed ratio to the shaft 7. The shaft 7 is at both ends thereof rotatably supported, by means of bearings not shown, to an arm 8 of the sewing machine. A hollow casing 9 is also mounted on the top plate of arm 8.

Disposed through the casing 9 is a push rod 10 which carries at one end thereof a wheel 12 provided with a lever 11. The wheel 12 has a portion 13 adapted to receive one end of the push rod 10. After receiving said end of the push rod into the portion 13, accordingly, the wheel 12 can be fixedly mounted to the push rod 10 by means of a screw 13′ or the like.

The portion 13 of wheel 12 is deep enough to control an inserted length of the push rod 10 into said portion. This means that a protruded length of the other end of push rod 10 from the casing 9 can be controlled.

Figure 2:
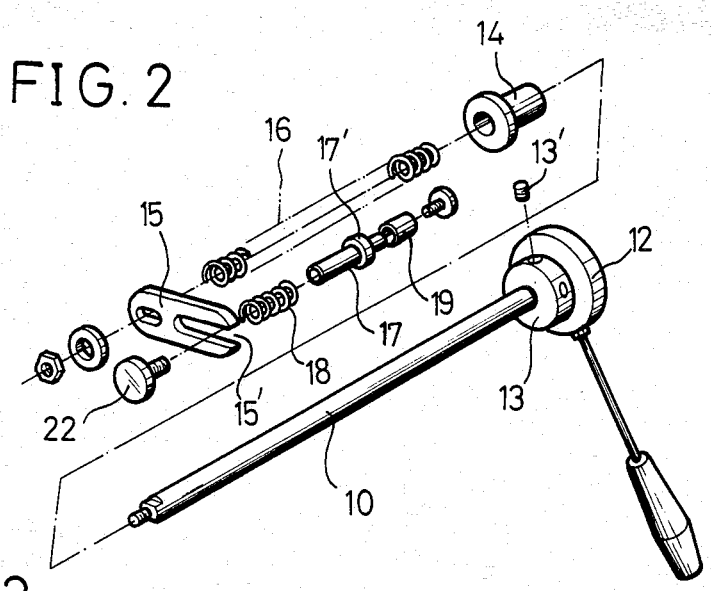
FIG. 2 is a exploded view of a part of the construction in accordance with the invention.

Within the casing 9, a coil spring 16 is disposed around the push rod 10 to urge the wheel 12 away from the casing 9 via a flanged bush 14 disposed between the spring 16 and the wheel 12, as shown in FIG. 2.

To the other end of push rod 10, a yoke 15 having a slot 15′ is mounted by means of a nut. To the yoke 15, an actuating shaft 17 which is disposed through a bearing member 21 of an actuating link 20, is connected by means of a screw 22 so that one end of the shaft 17 is slidably moveable in the slot 15′.

The shaft 17 also has at the other end thereof a roller 19 adapted to contact an outer surface of cam portion 2. A spring 18 is disposed around the shaft 17 and between an end wall of the bearing member 21 and a spring seat 17′ formed at a middle portion of the shaft 17. With this arrangement, the spring 18 always urges the shaft 17 toward a direction that the roller 19 makes contacts with the camming surface of cam 1. The link 20 is pivotally supported at the other end thereof to a side of the arm 8 and linked with a swing arm 24 via linkage member 23. The linkage member 23 is connected at both ends thereof to a middle portion of the link 20 and one end of the swing arm 24, respectively.

The link 20 is pivoted when the roller 19 rolls along the camming surface of cam 1. The swing arm 24 is at the other end thereof connected with a guide block 25 by means of a pin fixed to said end of the swing arm and a slot 26 of guide block 25 receiving said pin. Adjacent to the other end of swing arm 24, a spring 27 is at one end thereof connected to said swing arm.

The other end of said spring 27 is connected to the arm 8 of sewing machine.

Accordingly, the spring 27 urges the swing arm 24 to rotate in an anti-clockwise direction in FIG. 1. The guide block 25 is constructed to receive guide rods 29 extended downwardly from a bracket 28 fixed to the arm 8 of sewing machine.

When the swing arm 24 is swingedly moved by the pivotal movement of link 20, accordingly, the guide block 25 is reciprocated upwardly and downwardly along the guide rod 29. A support 31 supporting a cutter 30 is fixedly mounted to a side wall of the guide block 25. In FIG. 1, reference numeral 32 indicates a cutter-guiding member, 33 a needle-guiding member, and 34 a sewing die.

In the arrangement as above-mentioned, the push rod 10 is always urged toward the lever 11 by the spring 16, so that the yoke 15 mounted to said push rod forces the actuating shaft 17 to maintain the roller 19 thereof in contact with the camming surface of cam 1. When the sewing machine is operated in this state, the shaft 7 rotates by a rotation of the driving shaft 4.

Hence, the roller 19 rolls along the camming surface of the cam 1.

Figure 3:
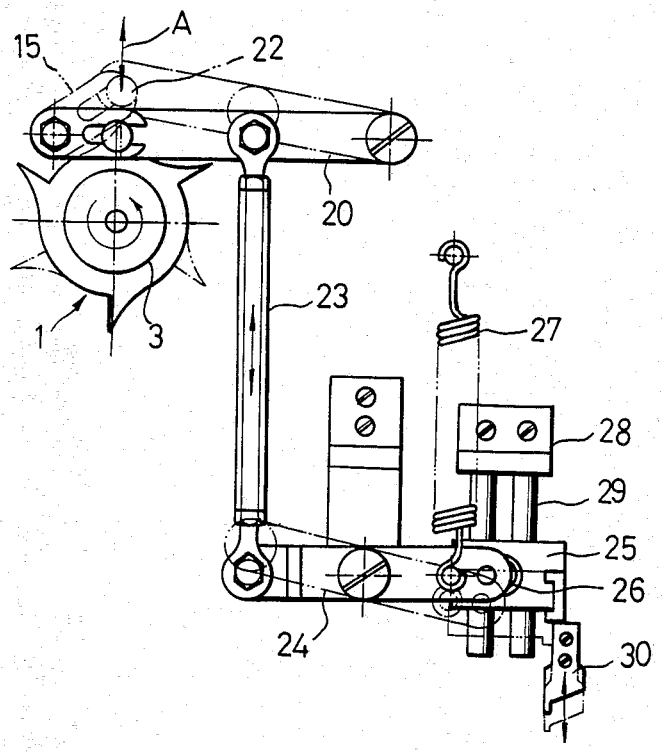
FIG. 3 is a partial side view for the explanation of the operation in accordance with the invention.

During the rolling, the roller 19 is moved upwardly toward a tip of a protrusion 2 of cam 1 and then moved downwardly from said protrusion to reach a next protrusion 2. In such a manner, the roller 19 is reciprocated in the direction "A" in FIG. 3. The reciprocation of roller 19 causes the link 20 connected coaxially with the roller 19 to pivot upwardly and downwardly. Thereby the swing arm 24, to which the pivotal movement of link 20 is transmitted via the linkage member 23, swings to move the guide block 25 upwardly and downwardly along the guide rod 29, so that the cutter 30 fixed to the guide block 25 performs a required notching on a workpiece. During the operation, the spring 27 disposed between the swing arm 24 and the arm 8 of the sewing machine urges the swing arm to continuously rotate in a anti-clockwise direction so that on escaping from said protrusion tip the roller 19 rapidly descends to the base of protrusion, thereby enabling a smooth and rapid movement of swing 24.

Figure 4:
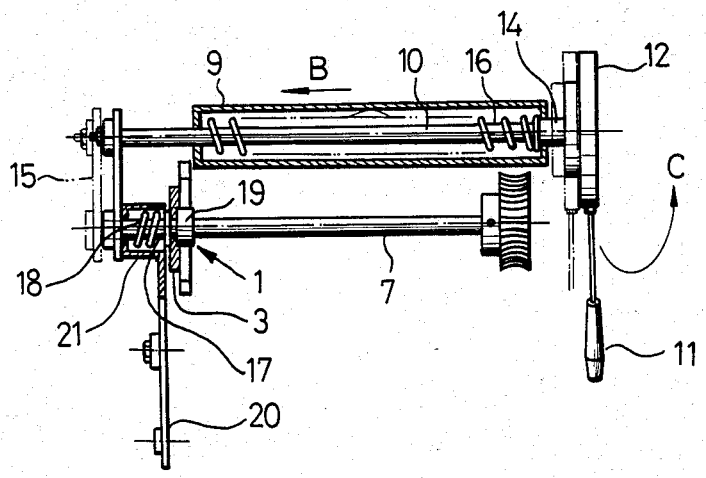
FIG. 4 is a sectional view for the explanation of the notching-releasing operation in accordance with the invention.
Figure 5:
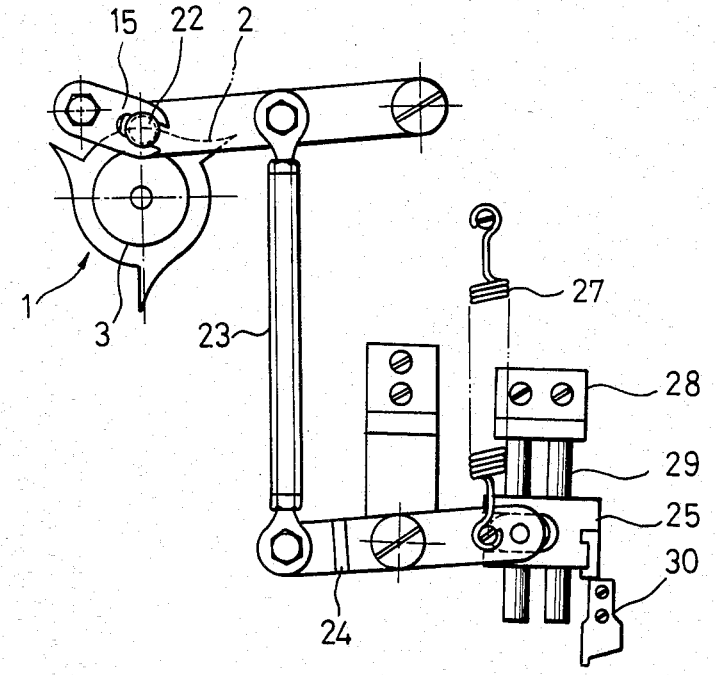
FIG. 5 is a side view showing a non-notching state in accordance with the invention.

When no notching operation is required, the push rod is to be pushed in the direction "B" in FIG. 4 against a force of the spring 16 to push the yoke 15 in the same direction. Then the actuating shaft 17 is moved against a force of the spring 18 by the protrusion of yoke 15, whereby the roller 19 is separated from the cam portion of cam 1. At the same time, the roller 19 descends and engages with the cylindrical boss portion 3 of cam 1 by a downward urging force of the link 20 caused by the spring 27 via the swing arm 24 and linkage member 23. As a result, the guide block 25 holding the cutter 30 is raised by the swing arm 24 to a non-notching position thereof.

When the notching operation is again required, the lever 11 is to be rotated in the direction "C" in FIG. 4 to rotate 10 and thus the yoke 15.

The rotation of yoke 15 cause the actuating shaft 17 and thus the roller 19 to raise. When raised to the level higher than that of camming surface of the cam 1, the roller 19 can be engaged with the cam portion of cam 1 by the movement of actuating shaft 17 resulting from the movement of push rod 10 in the direction "B" in FIG. 4 by a force of the spring 16. Thus, the roller 19 is again in a notching position. In notching operation, when speed rate between the worm 5 and the worm gear 6 is, for example, 24:1, the worm gear rotates one time per 24 rotations of the driving shaft 4. In this case, the cam 1 also rotates one time. Assuming the cam 1 to have three protrusions 2, accordingly, the link 20 pivots three times to cause the cutter 30 to move upwardly and downwardly three times. One stitch is provided by one rotation of the shaft 4.

Therefore, notching rate is one per eight stitches. Of course, the notching rate can be optionally changed by changing the number of teeth of the worm gear 6.

While preferred embodiment of the invention has been described, such description is for illustrative purposes only, and it is to be understood that changes and variations may be made without departing from the spirit and scope of the invention as defined in the following claims.

What is claimed is:

1. An automatic notching device in a sewing machine comprising;

a worm fixedly mounted to a driving shaft of the sewing machine, a rotating shaft provided at one end thereof with a worm gear engaging with said worm, a cam mounted to the other end of said rotating shaft, said cam having a cam portion formed with a plurality of protrusions and a cylindrical boss portion, an actuating shaft provided at one end thereof with a roller engaging with said cam, a link provided at one end thereof with a bearing member supporting said actuating shaft, said link being pivotable about the other end thereof, a yoke provided with a slot receiving the other end of actuating shaft, said actuating shaft being slideable in said slot, a push rod connected at one end thereof to said yoke and having at the other end thereof a lever, a swing arm connected at one end thereof to said link via a linkage member, and a cutter mounted to the other end of said swing arm.

* * * * *